US005966576A

United States Patent [19]

Tyagi et al.

[11] Patent Number: 5,966,576

[45] Date of Patent: Oct. 12, 1999

[54] EXTENDED DEVELOPMENT ZONE APPARATUS WITH ROTATING MAGNETS

[75] Inventors: Dinesh Tyagi, Fairport; Brandon H. Brown, Kendall, both of N.Y.

[73] Assignee: Eastman Kodak Company, Rochester, N.Y.

[21] Appl. No.: 08/901,808

[22] Filed: Jul. 28, 1997

[51] Int. Cl.[6] ..... G03G 15/09

[52] U.S. Cl. ..... 399/278; 399/267

[58] Field of Search ..... 399/267, 269, 399/276, 277, 278, 294, 292; 198/619, 679, 690.1

[56] References Cited

U.S. PATENT DOCUMENTS

| | | | |
|---|---|---|---|
| 2,786,439 | 3/1957 | Young . | |
| 2,786,440 | 3/1957 | Giaimo, Jr. . | |
| 2,786,441 | 3/1957 | Young . | |
| 3,113,042 | 12/1963 | Hall . | |
| 3,469,911 | 9/1969 | Olden . | |
| 3,545,968 | 12/1970 | Sato . | |
| 3,584,601 | 6/1971 | Turner | 399/278 |
| 3,592,166 | 7/1971 | Wu | 399/288 |
| 3,906,121 | 9/1975 | Fraser et al. | 430/122 |
| 3,921,577 | 11/1975 | Howard et al. . | |
| 3,962,992 | 6/1976 | Takagi et al. | 399/292 |
| 4,004,508 | 1/1977 | Rarey et al. | 101/114 |
| 4,246,867 | 1/1981 | Hudson | 399/269 |
| 4,370,056 | 1/1983 | Hays | 399/269 |
| 4,412,733 | 11/1983 | Doutney . | |
| 4,459,345 | 7/1984 | Probst | 430/122 |
| 4,473,029 | 9/1984 | Fritz et al. . | |
| 4,546,060 | 10/1985 | Miskinis et al. . | |
| 4,614,420 | 9/1986 | Lubinsky et al. | 399/277 |
| 4,707,107 | 11/1987 | Joseph . | |
| 4,822,708 | 4/1989 | Machida et al. . | |
| 4,920,023 | 4/1990 | Koch et al. . | |
| 4,960,069 | 10/1990 | Kaieda . | |
| 5,181,075 | 1/1993 | Rubin | 399/267 |
| 5,272,037 | 12/1993 | Ohtani et al. . | |
| 5,330,874 | 7/1994 | Mahabadi et al. . | |
| 5,332,638 | 7/1994 | Creatura . | |
| 5,416,571 | 5/1995 | Yamada et al. . | |

FOREIGN PATENT DOCUMENTS

| | | |
|---|---|---|
| 3734263 | 4/1988 | Germany . |
| 4-090581 | 3/1992 | Japan . |
| 6-40562 | 2/1994 | Japan . |

OTHER PUBLICATIONS

B. D. Cullity; Introduction to Magnetic Materials; 1972; p. 18; Addison–Wesley Publishing Company, 1972.

*Primary Examiner*—Robert Beatty
*Attorney, Agent, or Firm*—Lawrence P. Kessler

[57] ABSTRACT

A magnetic brush development station for developing latent image charge patterns supported on a moving image support member of an electrostatographic reproduction apparatus. The magnetic brush development station includes a housing located in operative association with an extended run of the image support member. The housing has a portion constituting a sump for developer material, and a portion defining an opening facing the image support member. Further, the magnetic brush development station includes an applicator for applying developer material to a latent image charge pattern on the image support member to develop such latent image charge pattern. The applicator includes a sleeve located in the last mentioned portion of the housing, above the developer material sump, the sleeve having a development surface operatively associated with the image support member through the opening and configured to complementarily conform to the run of the image support member to define an extended uniform development zone. A plurality of rotatable magnets are located adjacent to the underside of the development surface of the sleeve to move developer material through the development zone.

11 Claims, 2 Drawing Sheets

EXTENDED DEVELOPMENT ZONE APPARATUS WITH ROTATING MAGNETS

FIELD OF THE INVENTION

This invention relates in general to the development of latent images in electrostatographic reproduction apparatus, and more particularly, to the development of electrostatographic latent images using a reproduction apparatus magnetic brush development station which provides an extended development zone usable with various types of carrier particles.

BACKGROUND OF THE INVENTION

Electrostatographic latent images are typically developed using a magnetic brush development station. A magnetic brush development station typically includes a magnet with a mass of iron oxide particles or ferromagnetic powder magnetically attracted to the magnet in a chain-like arrangement. The chain-like arrangement of the magnetic particles simulates a brush. A powder toner, of pigmented or non-pigmented particles for example, is dispersed within the arrangement of magnetic particles and mixed so as to be triboelectrically charged so that the developer material includes toner powder and magnetic carrier particles of opposite polarity. The charged particles of toner are then used for the development of a latent image charge pattern formed on an image support member. The general concept of magnetic brush development has been disclosed in U.S. Pat. Nos. 2,786,439 and 2,786,440 and 2,768,441. Common magnetic brush development stations include magnetic roller(s) which carry the developer material, including the ferromagnetic carrier particles and powdered toner, into operative association with the latent image charge pattern on an image support member. When resulting rotating magnetic brush fibers move relative to the latent image charge pattern, the contact of the magnetic brush fibers with the image support member enables some of the charged toner particles to transfer to the charge pattern of the latent image.

Although such magnetic brush development stations are widely used in electrostatographic reproduction apparatus (such as copiers, printers, or the like), there are some inherent problems associated therewith. In most instances, when unoxidized, or partially oxidized iron oxide, stainless steel, magnetite or soft ferrite are used as the carrier particles, some such particles are also carried across the development gap into contact with the image support member by the arrangement of magnetic brushes. In such magnetic brushes, the magnetic core is stationary while a rotating shell provides for the transportation of the developer material across the surface of the image support member. Accordingly, the conductivity of one of these ferromagnetic particles provides the effect of a development electrode with very close spacing to the latent image. When the carrier particles become less conductive with age, for example due to toner scumming, the developing electric field is lowered which in turn reduces the amount of toner transferred to the image. In order to address this short coming, the use of small carrier particles has been promoted. The typical size of the carrier particles that are utilized range form 50 to 200 microns and these particles are coated with a polymer to optimize toner charging, prevent toner scumming and loss of carrier conductivity. For such carrier particle sizes, the amount of toner concentration usually ranges from 1 to 6 percent by weight of the developer material.

Another major concern with magnetic brush development stations of this type is the removal of counter charge. As the toner particles are attracted by the electrostatic latent image, the opposite charge of the carrier particles is exposed. This counter charge lowers the effective electrical field available for development and eventually leads to a reduction in toner development. In addition, most types of the carrier particles used in such development modes are prone to mechanical brittle failure of the particle surface. This surface fracture or breaking up of the carrier surfaces not only changes the triboelectric behavior of the developer material, but also changes the developer conductivity and makes the material more sensitive to changes in relative humidity. Various approaches have been suggested for maintaining sufficient electrical conductivity of the carrier particles by techniques such as incorporating conductive fillers or additives to the carrier coatings (see for example U.S. Pat. Nos. 4,822,708; 5,330,874; 5,332,638 and 5,272,037, the disclosures of which are incorporated herein by reference). Various methods are also practiced which help with the relative humidity stability of such carriers (see U.S. Pat. No. 4,920,023, incorporated herein by reference).

The use of insulative carrier in the development of latent image charge patterns eliminates the need for maintaining the electrical conductivity. Such use of insulative carrier is particularly useful for developing a fringe-field image. Carrier used for such applications comprise ferromagnetic material such as iron, nickel or other soft ferrite whose surface is uniformly coated with an insulative resin. However, insulative developers have an extremely difficult time getting rid of the counter charge left on the insulating carrier surface which can lead to shutdown of the entire development even at slow speeds.

In the case of soft ferrite or iron oxide powered carrier, the developer shell is rotated around a fixed magnetic core. The developer material is carried across the development zone in the vicinity of the image support member. The developer chains with such non-permanent or soft magnetic carrier particles are essentially carried across the development zone without any rearrangement or alteration. The spent developer then falls off the surface of the magnetic brush shell once it has traveled sufficiently away form the stationary magnets in the development roller. Once in the developer station sump, the spent developer can lose its counter charge.

More recently, hard magnetic materials have been used to carry and deliver the toner particles to the electrostatic image on the image support member. Many of the problems encountered with "soft" type particles are solved with the use of "hard" ferrite as carriers. However, because the magnetic attraction between the permanent magnetic core and the permanently magnetic hard ferrite carrier is so high, the developer station has to be significantly modified. One such developer station is described in U.S. Pat. No. 4,707,107, the disclosure of which is incorporated herein by reference. In the case of soft ferrite and iron oxide powder carriers, the developer station shell is rotated around a fixed magnet. When developers based on hard ferrite carrier particles are used, the magnetic core of the development roller (which contains between 4 to 30 magnetic material elements arranged sequentially in north-south pole alignment) is rotated. This causes the chains of the magnetic carrier particles, which form the development brush, to flip end-to-end at very high rates. As such, it is well recognized that the hard magnetic material carriers are not analogous to the soft carrier materials.

U.S. Pat. Nos. 4,546,060 to Miskinis et al. and 4,473,029 to Fritz et al. teach the use of hard magnetic materials as carrier particles and an apparatus for the development of electrostatic images utilizing such hard magnetic carrier particles, respectively. These patents require that the carrier particles comprise a hard magnetic material, meaning a magnetic material exhibiting a coercivity of at least 300 Oersteds when magnetically saturated and exhibiting an induced magnetic moment of 20 EMU/g when in an applied magnetic field of 1000 Oersteds. The terms "hard" and "soft" when referring to magnetic materials have the generally accepted meaning as indicated on page 18 of *Introduction to Magnetic Materials* by B. D. Cullity published by Addison-Wesley Publishing Company, 1972.

The biggest advantage of using hard ferrite carrier particles in a magnetic brush development station is that there are large number of chain flips taking place as the magnetic core is being rotated while the shell is essentially stationary. The number of chain flips can range form between 500 to 25,000 flips per minute. The consequence of these carrier chain flips is that there is no build up of the counter charge in the development zone. Any counter charge resulting in this development technique is bled away once the carrier chain flips and contact the magnetic brush shell. The size of the hard ferrite carrier particle employed in this method typically range from 20 to 40 microns. By using such small carrier particles, it is possible to maintain a toner concentration of between 5 and 15 percent by weight. With such small carrier particles, the development gap is generally between 0.4 and 1 millimeters and the carrier core resistance is of the order of 11 to 14 Log ohm-cm.

Although both of the described methods for magnetic brush development are practiced widely, there are certain limitations with each of them. For example, since both these methods utilize a cylindrical magnetic brush, the size of the development nap is determined by the height of the developer on the magnetic brush and the diameter of the roller. Very frequently, with such magnetic brush, the development time available in the development nap for a latent image is not sufficient to enable the complete development of the image. To address this problem, a plurality of magnetic brush rollers may be arranged in series to act sequentially on the same latent image to completely develop such image. It is not uncommon to have four development rollers arranged in serial fashion when 100 to 150 micron iron oxide or soft ferrite carrier particles are being used. As mentioned above, the counter charge left on the carrier surface of this type can stop the development of the toner to the image support member. This behavior is also responsible for making it necessary to use more than one magnetic developer brush.

On the other hand, when hard carrier particles are being used, the counter charge is constantly being removed by the large number of carrier chain flips taking place on the development roller surface. Therefore, the problem related to counter charge build-up which slows down the toner development, does not exist. However, the high magnetic strength of the rotating magnetic core does not permit the use of a series of magnetic brushes with respective rotating magnetic cores. This is because of the extremely high amounts of heat which would be produced by the Eddy currents generated by the action of adjacent magnetic cores rotating in close proximity. As a result of this difficulty, it is not possible to arrange a series of developer rollers to increase development efficiency. Further, as a result of the development station configuration and the magnetic properties of the carrier used, the hard ferrite carrier does not perform well in a station arranged for using iron oxide, magnetite, stainless steel or soft ferrite carrier particles, and vice versa.

SUMMARY OF THE INVENTION

In view of the above discussion, it is the purpose of this invention to provide a development station for an electrostatographic reproduction apparatus which enables extended control over the development zone for a magnetic brush type development station, and further controls the build-up of counter charge on the carrier particles and is capable of using both soft and hard ferromagnetic materials without requiring a major modification of the developer station configuration. The magnetic brush development station includes a housing located in operative association with an extended run of the image support member. The housing has a portion constituting a sump for developer material, and a portion defining an opening facing the image support member. Further, the magnetic brush development station includes an applicator for applying developer material to a latent image charge pattern on the image support member to develop such latent image charge pattern. The applicator includes a sleeve located in the last mentioned portion of the housing, above the developer material sump, the sleeve having a development surface operatively associated with the image support member through the opening and configured to complementarily conform to the run of the image support member to define an extended uniform development zone. A plurality of rotatable magnets are located adjacent to the underside of the development surface of the sleeve to move developer material through the development zone.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
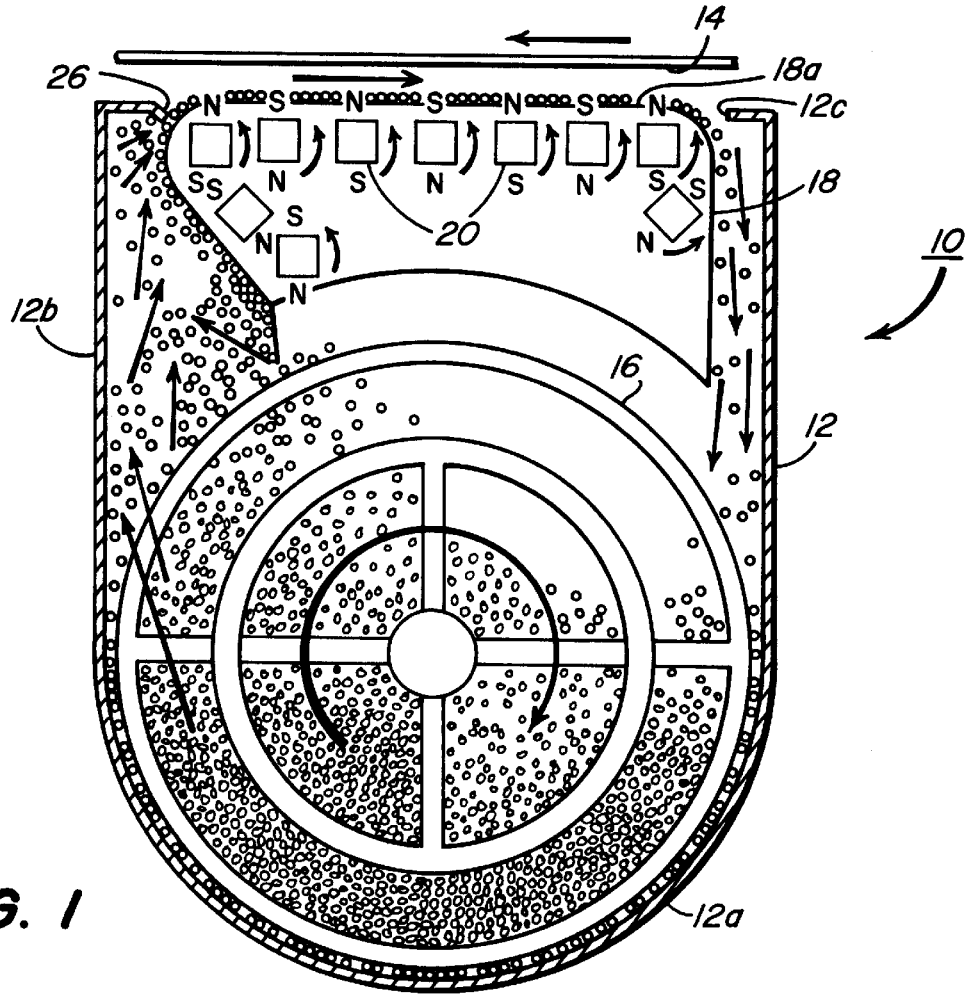
FIG. 1 is a side elevational view, partly in cross-section, of an electrostatographic reproduction apparatus magnetic brush development station according to this invention, with portions removed to facilitate viewing.

Referring now to the accompanying drawings, FIG. 1 shows a magnetic brush development station, designated generally by the numeral 10, according to this invention, for use in an electrostatographic reproduction apparatus utilizing a moving image support member 14 upon which a developable latent image charge pattern is formed in a well known manner. The development station 10 includes a housing 12 adapted to be located such that the image support member 14 includes a run which moves relative to the housing (in the direction of the associated arrow) so as to be in an operative development relation therewith. The housing 12 has a developer material sump 12*a* located in the lower portion thereof. The sump 12*a* is loaded with developer material comprising carrier particles and toner particles. The toner particles, in the size range of about 10–300 microns, may be pigmented or non-pigmented. The carrier particles, as will be explained hereinbelow, may be formed of either soft or hard ferromagnetic material which is coated or non-coated with an insulative resin. A blender 16 within the sump 12*a* of the housing is rotatable to mix the components of the developer material. The mixing action of the blender 16 produces triboelectric charging which causes the toner particles to adhere to the carrier particles in a well known manner.

The upper portion 12*b* of the housing 12 includes an opening 12*c* facing the image support member 14. A developer material applicator a is located in the upper portion 12*b* of the housing 12, above the blender 16, in juxtaposition with the opening 12*c*. The applicator a includes a non-magnetic sleeve 18 having a development surface 18*a* , of suitable configuration, extending through the opening 12*c* into operative association with the image support member 14. The configuration of the development surface 18*a* is selected to complementarily conform to the configuration of the image support member over its run adjacent to the development station 10. While the respective configurations are shown in the drawings as being substantially planar, they could of course be of any other suitable configurations such as arcuate for example. A skive 26 extends from an edge of the opening 12*c* in a manner to serve to meter the flow of developer material onto the development surface 18*a*.

Figure 2:
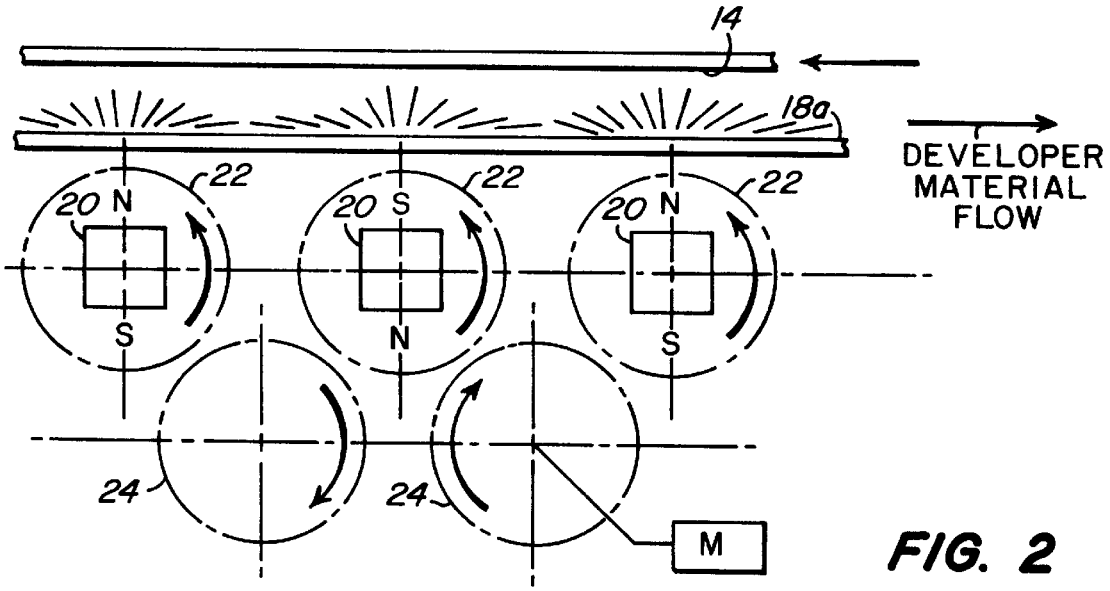
FIG. 2 is a schematic side elevational view, on an enlarged scale, of a portion of the magnetic brush development station of FIG. 1 showing the interrelation between the magnets and the orientation of developer material chains.
Figure 3:
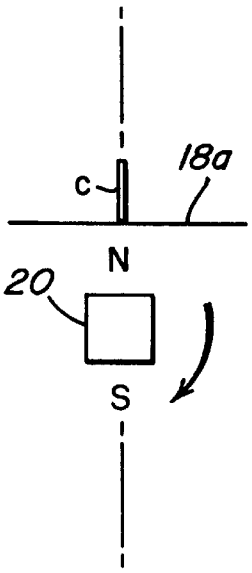
FIGS. 3–10 are schematic side elevational views, on an enlarged scale, respectively showing the sequence of orientation and movement of a single developer material as a magnet of the magnetic brush development station, according to this invention as shown in FIG. 1, rotates.
Figure 4:
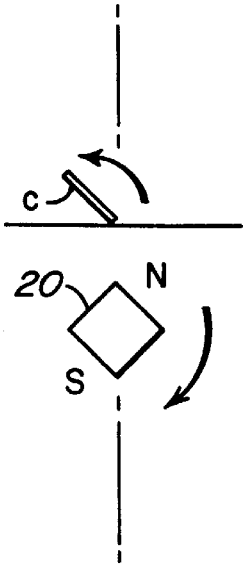
Figure 5:
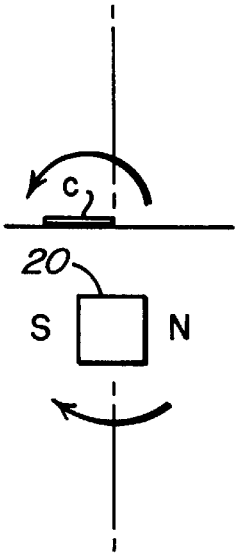
Figure 6:
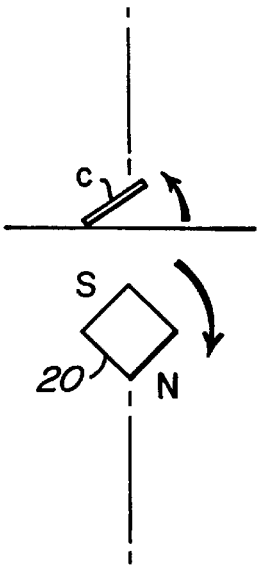
Figure 7:
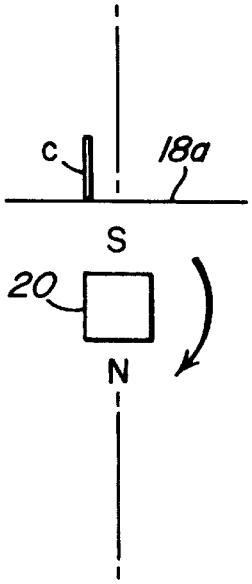
Figure 8:
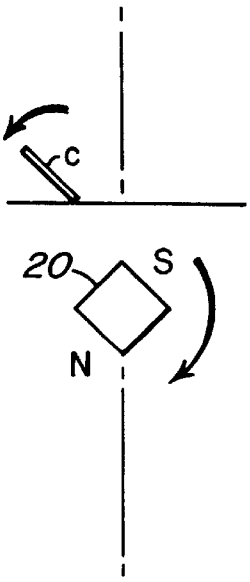
Figure 9:
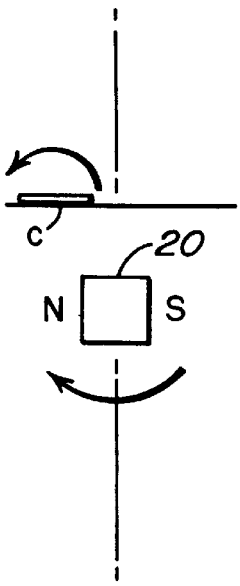
Figure 10:
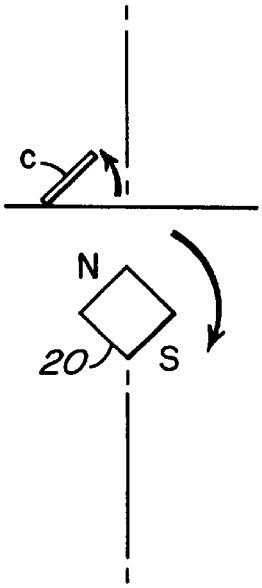

A plurality of rotatable magnets 20 are located within the sleeve 18 adjacent to the underside of the development surface 18*a* to provide a uniform development zone which extends over substantially the entire development surface. The placement, and orientation, of the magnets 20 is extremely critical to ensure that proper developer flow takes place along the development surface 18*a*. The plurality of magnets 20 are pinned to a plurality of gears 22 respectively (see FIG. 2), one of which is selectively driven by the motor M. The gears 22 respectively intermesh with intermediate gears 24. The pitch diameter for each of the gears 22 and intermediate gears 24 is substantially equal. In this manner, the magnets 20 under the development surface 18*a* are rotated at the same angular velocity such that the poles of adjacent magnets are always 180° out of phase with each other.

As is well known, the magnets of a magnetic brush development station cause developer material to form elongated chains which align with the fields of the magnets. For the magnetic brush development station 10 according to this invention, when the magnets 20 below the development surface 18 of the sleeve 18 are rotated in unison by the motor M, through the gears 22, 24, the developer material will flow across the developer surface to develop a latent image charge pattern on the image support member 14 moving in operative association therewith. More particularly, the developer material travels along the development surface 18*a* by flipping action of the elongated chains. As shown in FIGS. 3–10, as a magnet 20 rotates, an elongated developer material chain C will follow the changing orientation of the associated magnetic field. That is, the elongated chain will flip end-to-end and will walk along the development surface 18*a* in a direction which is opposite to the direction of rotation of the magnet adjacent to the development surface. For each complete (360° ) rotation of a magnet, the associated developer material chains will flip twice. Such flipping and walking actions is duplicated with each magnet and for all the associated developer material chains. The number of chain flips can range form between 500 to 25,000 flips per minute.

It can be readily appreciated that the above discussed problem of counter charge build-up is avoided by the magnetic brush development station 10 according to this invention. Any counter charge on the surface of a carrier particle in a development material chain, resulting from toner particles being removed (due to image development) from a developer material chain, is readily removed when the chain flips and contacts the developer surface 18*a* of the sleeve 18 and picks up fresh toner particles. As a result of the tumbling action of the developer material chains due to the flipping action on magnet rotation, fresh toner particles are brought into contact with the surface of the image support member 14 for more efficient and complete development of a latent image charge pattern thereon. Further, it has been found that the magnetic brush developer station 10, as described, is able to transport both hard and a soft ferromagnetic carrier materials in a similar manner. In fact, it was difficult to distinguish between the appearance of the magnetic brush developer material chains when using either the hard or the soft ferromagnetic materials of the same particle size. Moreover, with the particular arrangement of the magnets to the development surface of the sleeve as described, the development surface can be made to complementarily conform to almost any shape variation for the image support member through a development zone. As such, complete control over the development action in the development zone distance can be achieved with the magnetic brush developer station according to this invention.

The invention has been described in detail with particular reference to certain preferred embodiments thereof, but it will be understood that variations and modifications can be effected within the spirit and scope of the invention.

PARTS LIST

10—magnetic brush development station
12—housing
12*a*—sump
12*b*—housing upper portion
12*c*—housing opening
14—image support member
16—blender
18—sleeve
18*a*—sleeve development surface
20—magnets
22—gears
24—intermediate gears
M—motor
C—developer material chains

What is claimed is:

1. A magnetic brush development station for developing latent image charge patterns supported on a moving image support member of an electrostatographic reproduction apparatus, said magnetic brush development station comprising:

a housing located in operative association with an extended run of said image support member, said housing having a first portion constituting a sump for developer material, and a second portion defining an opening facing said image support member; and an applicator for applying developer material to a latent image charge pattern on said image support member to develop such latent image charge pattern, said applicator including a fixed sleeve located in said second portion of said housing, said fixed sleeve having a development surface operatively associated with said image support member through said opening and configured to complementarily conform to said run of said image support member even when said image support member is non-planar, to define an extended uniform development zone, and a plurality of magnets adjacent to the side of said development surface of said fixed sleeve opposite said development zone, said magnets being rotatable in an appropriate direction to move developer material through said development zone in a direction opposite the direction of movement of said image support member.

2. The magnetic brush development station according to claim 1 wherein said plurality of magnets have a plurality of intermeshing gears respectively associated therewith, and a motor for rotating said gears, and thus said magnets, at the same angular velocity.

3. The magnetic brush development station according to claim 2 further including intermediate gears respectively located between said plurality of gears and intermeshing therewith, said plurality of gears and said intermediate gears having equal pitch diameters such that said magnets will be rotated 180° out of phase.

4. A magnetic brush development station for developing latent image charge patterns, supported on a moving image support member of an electrostatographic reproduction apparatus, with developer material including toner particles and carrier particles, said magnetic brush development station comprising:

a housing located in operative association with an extended run of said image support member, said housing having a first portion constituting a sump for said developer material, and a second portion defining an opening facing said image support member; and an applicator for applying developer material to a latent image charge pattern on said image support member to develop such latent image charge pattern, said applicator including a fixed sleeve located in said second portion of said housing, above said developer material sump, said fixed sleeve having a development surface operatively associated with said image support member through said opening and configured to complementarily conform to said run of said image support member, even when said image support member is non-planar, to define an extended uniform development zone, and a plurality of rotatable magnets adjacent to the underside of said development surface of said fixed sleeve for forming elongated chains of developer material, and a motor for rotating said magnets so as to move said developer material chains through said development zone by causing said developer material chains to repeatably flip in the development zone.

5. The magnetic brush development station according to claim 4 wherein said plurality of magnets have a plurality of intermeshing gears respectively associated therewith, whereby said motor rotates said gears, and thus said magnets, at the same angular velocity.

6. The magnetic brush development station according to claim 5 wherein said motor rotates said magnets so as to causing said developer material chains to repeatably flip at the rate of between about 500–25000 flips per min.

7. The magnetic brush development station according to claim 5 further including intermediate gears respectively located between said plurality of gears and intermeshing therewith, said plurality of gears and said intermediate gears having equal pitch diameters such that said magnets will be rotated 180° out of phase.

8. The magnetic brush development station according to claims 4 wherein said carrier particles of said developer material are formed of soft ferromagnetic material.

9. The magnetic brush development station according to claim 4 wherein said carrier particles of said developer material are formed of hard ferromagnetic material.

10. The magnetic brush development station according to claim 4 wherein said carrier particles of said developer material are coated, or uncoated, with an insulative resin.

11. The magnetic brush development station according to claim 4 wherein said toner particles of said developer material are of a size in the range of 10–300 microns.

* * * * *